US012025113B2

(12) United States Patent
Ruan et al.

(10) Patent No.: US 12,025,113 B2
(45) Date of Patent: Jul. 2, 2024

(54) SHAFT-DISTRIBUTED DOUBLE-ACTING ROLLER PISTON PUMP

(71) Applicant: ZHEJIANG UNIVERSITY OF TECHNOLOGY, Zhejiang (CN)

(72) Inventors: Jian Ruan, Zhejiang (CN); Chenchen Zhang, Zhejiang (CN); Chengwei Tong, Zhejiang (CN); Bin Meng, Zhejiang (CN); Ke Zhu, Zhejiang (CN); Chuantan Ruan, Zhejiang (CN)

(73) Assignee: ZHEJIANG UNIVERSITY OF TECHNOLOGY, Zhejiang (CN)

( * ) Notice: Subject to any disclaimer, the term of this patent is extended or adjusted under 35 U.S.C. 154(b) by 113 days.

(21) Appl. No.: 17/964,558

(22) Filed: Oct. 12, 2022

(65) Prior Publication Data

US 2023/0184233 A1 Jun. 15, 2023

(30) Foreign Application Priority Data

Dec. 13, 2021 (CN) ..... 202111515594.6

(51) Int. Cl.
*F04B 1/141* (2020.01)

(52) U.S. Cl.
CPC ..... *F04B 1/141* (2013.01)

(58) Field of Classification Search
CPC .... F04B 9/042; F04B 1/22; F04B 5/02; F04B 1/14–188
See application file for complete search history.

(56) References Cited

U.S. PATENT DOCUMENTS 1,229,009 A * 6/1917 Allison ..... F04B 1/146 92/138
2008/0006237 A1* 1/2008 Page ..... F02B 75/282 123/241
2008/0219861 A1* 9/2008 Raleigh ..... F04B 9/042 417/415
2010/0236522 A1* 9/2010 Page ..... F02B 53/02 123/43 AA

FOREIGN PATENT DOCUMENTS

CN 107747531 A * 3/2018 ..... F04B 1/16
CN 107795447 A * 3/2018 ..... F04B 1/02
CN 107795447 B * 5/2019 ..... F04B 1/02
CN 115263709 A * 11/2022

* cited by examiner

*Primary Examiner* — Thomas Fink
(74) *Attorney, Agent, or Firm* — MUNCY, GEISSLER, OLDS & LOWE, P.C.

(57) ABSTRACT

A shaft-distributed double-acting roller piston pump includes a front end cover, a pump casing, a rear end cover and a pump core assembly. The pump core assembly includes a guide rail assembly including left and right guide rails arranged back to back. The side surfaces of the left and right guide rails away from each other are space cam curved surfaces. A flow distribution shaft is installed in the center of the guide rail assembly. A cylinder assembly is installed on both sides of the guide rail assembly including left and right cylinders, between which a piston assembly is arranged. The piston assembly forms left and right closed cavities with the left and right cylinders respectively. The piston assembly performs axial reciprocating linear motion under the constraint of the cylinder assembly and the guide rail assembly, and the volumes of the left and right closed cavities change continuously.

3 Claims, 10 Drawing Sheets

SHAFT-DISTRIBUTED DOUBLE-ACTING ROLLER PISTON PUMP

FIELD OF THE INVENTION

The present invention relates to a hydraulic piston pump, and more particularly, to a shaft-distributed double-acting roller piston pump.

BACKGROUND OF THE INVENTION

Hydraulic systems are widely used in important fields such as aviation, aerospace, and navigation. As an energy power component, hydraulic pumps play a decisive role in the performance, efficiency and application fields of hydraulic systems. Especially the axial piston pump, as a typical representative of hydraulic pump. It has the characteristics of high pressure, high speed and large flow, which meets the development and application requirements of high hydraulic power density. In recent years, with the rapid development of the industry, the requirements for hydraulic pumps are also increasing day by day. Due to the limitations of friction pairs, size and other factors, traditional piston pumps can no longer meet the needs of high speed, stability and light weight.

The structural principle of the traditional axial piston pump is that several (usually 5, 7 or 9) pistons rotate with the cylinder block, and one end of the pistons reciprocate relative to the cylinder block under the constraint of the swash plate or the inclined shaft-ball hinge. During the movement, a periodically changing working volume is formed in the cylinder block hole, and the oil is sucked and discharged through the channel at the bottom of the cylinder block and communicated with the high and low pressure waist-shaped grooves of the distribution plate.

In order to break through the constraints of sliding friction pairs on pump performance, Jian Ruan et al. proposed a two-dimensional (2D) piston pump. In the two-dimensional (2D) piston pump, the cylinder block and the piston adopt an axisymmetric structure, and the piston is always in a state of radial force balance during the process of rotation and axial reciprocation, so there is no cylinder-valve friction pair and piston-cylinder friction pair. In addition, the hydrostatic pressure on the piston during oil discharge is supported by the roller-saddle rail rolling pair on the same side, because the hydrostatic pressure generated by a single piston (equal to the annular piston area multiplied by the pump outlet pressure) is limited. Therefore, standard high-efficiency rolling bearings can be directly selected between the rollers and their shafts. Similarly, in the roller-fork coupling, rolling bearings can also be used between the rollers and shafts. Obviously, there is no sliding friction pair in the two-dimensional (2D) axial piston pump, so the restriction of the friction pair on the pump performance and other aspects is completely avoided. The two-dimensional piston pump is also a positive displacement pump in nature, so it also has problems such as cavitation, cylinder tilt, flow pulsation, and noise. In order to eliminate the influence of the gap between the guide rail and the roller on the efficiency of the piston pump and further increase its speed, a stacked-roll two-dimensional (2D) piston pump is proposed. However, the above-mentioned pumps cannot achieve the two performances of eliminating the structural flow pulsation of the pump and offsetting the axial inertial force at the same time, so that the two-dimensional pump still faces a series of challenges under high speed conditions.

SUMMARY OF THE INVENTION

In order to overcome the above problems of the current technology, the present invention provides a shaft-distributed double-acting roller piston pump that simultaneously realizes the elimination of the structural flow pulsation of the pump and the cancellation of the axial inertial force, which also retains the advantages of the two-dimensional piston pump using rolling support instead of sliding support.

The technical scheme adopted in the present invention is: a shaft-distributed double-acting roller piston pump include comprises a front end cover, a pump casing and a rear end cover that are sequentially and coaxially arranged along the axis line, and a pump core assembly is arranged in the cavity formed between the front end cover, the pump casing and the rear end cover.

The pump casing is cylindrical which is provided with a low-pressure oil inlet and a high-pressure oil outlet in sequence from left to right. The inner wall of the pump casing is provided with a second annular groove at a position corresponding to the low-pressure oil inlet which communicates with the second annular groove 23. The inner wall of the pump casing is provided with a third annular groove at a position corresponding to the high-pressure oil outlet which communicates with the third annular groove.

The axis line of the guide rail assembly coincides with the axis line of the pump casing. The guide rail assembly includes a left guide rail and a right guide rail that are arranged back to back where in the projection of the left guide rail and the right guide rail in the axis line direction is an annular, and the side surfaces of the left guide rail and the right guide rail close to each other is a plane surface while that far away from each other is a space cam curved surface constructed by a constant acceleration and constant deceleration curve with multiple crests and troughs, wherein the number of crests is equal to the number of troughs while the crests of the left rail corresponds to the troughs of the right rail, i.e. the high points on the left rail corresponds to the low points on the right rail.

Square keys are arranged in the center holes of the left guide rail and that of the right guide rail, and beveled grooves are respectively formed on the surfaces of the left guide rail and that of the right guide rail close to each other. The beveled groove is provided with a wedge of which both sides are respectively installed in the beveled groove and in the radial circular hole of the flow distribution shaft;

The flow distribution shaft is cylindrical which passes through the center holes of the left guide rail and that of the right guide rail, and the right end of which passes through the first through hole in the center of the rear end cover; The middle part of the flow distribution shaft is provided with a boss fitting with the square key of the guide rail, and the boss is provided with a radial hole matched with the wedge; several through-hole flow channels are uniformly distributed on the flow distribution shaft along the circumferential direction, and the axis of the through-hole flow channels is parallel to that of the flow distribution shaft; The areas beside the boss on the flow distribution shaft is respectively provided with a group of rectangular flow distribution windows including large windows and small windows which are staggered along the circumferential direction of the flow distribution shaft, and are connected with the corresponding through-hole flow channels respectively.

The cylinder assembly includes a left cylinder block and a right cylinder block coaxially arranged with the pump casing. The left cylinder and the right cylinder block have the same structure and are respectively arranged on the left side and right side of the guide rail assembly in opposite directions.

The middle of the left cylinder block is uniformly provided with several radially through circular low pressure flow channels along the circumferential direction; A fifth annular groove and a sixth annular groove respectively connected with the oil inlet and the oil outlet of the circular low-pressure flow channel are respectively opened on the outer and inner walls of the left cylinder block at positions corresponding to the circular low pressure flow channels; The left end face of the left cylinder block has several countersunk through holes evenly distributed along the circumferential direction and dislocated with the circular low-pressure flow channel; The inner wall of the left portion of the left cylinder block is provided with several oil passages along the circumferential direction which are connected with the countersunk through holes. The left end face of the left cylinder block is also provided with two pin holes with a phase difference of 180°, two oil leakage ports with a phase difference of 180°; The right end face of the left cylinder block is provided with an annular boss protruding axially along the left cylinder block which is provided with several rectangular grooves uniformly distributed in the circumferential direction; The outer peripheral wall of the left cylinder block is also provided with a seventh annular groove and an eighth annular groove for installing the sealing ring.

The left cylinder block and the right cylinder block are connected by positioning pins which is cylindrical, and is divided into a first section, a second section and a third section sequentially from left to right, And two flanges are provided on the second section which are respectively matched with the pin holes on the left cylinder block and that on the right cylinder block; and a plug is respectively provided at the end of the countersunk through hole away from the guide rail assembly on the left cylinder block and that on the right cylinder block; and the plug is cylindrical which is provided with a ninth annular groove for installing the sealing ring.

A first circular blind hole is opened on the right end surface of the front end cover at a position corresponding to the plug of the left cylinder block; An oil leakage hole connected with the oil leakage port of the left cylinder block is opened on the right end surface of the front end cover at a position corresponding to the oil leakage port; The outer peripheral wall of the front end cover is provided with a first annular groove for installing the sealing ring.

A second circular blind hole is opened on the left end face of the rear end cover at a position corresponding to the plug of the right cylinder block. The outer peripheral wall of the rear end cover is provided with a fourth annular groove for installing the sealing ring. A first through hole is opened in the center of the rear end cover, and a plurality of countersunk holes evenly distributed in the circumferential direction are opened on the right end surface of the rear end cover. The countersunk hole is connected to the pump casing by bolts, and a plurality of second through holes evenly distributed in the circumferential direction are opened on the right end face of the rear end cover, and the second through holes are used for connecting the tooling.

Piston assemblies is arranged in the countersunk through holes between the left cylinder block and the right cylinder block. A piston assembly includes a piston, a cylindrical roller, a needle roller and a pin. A piston includes a truss and a piston body connected to the left and right ends of the truss. The truss is provided with pin holes symmetrically left and right, the axis of the pin hole is arranged along the radial direction of the pump casing, a pin shaft is installed in the pin hole, and a roller is installed on the pin shaft. The left and right rollers on the truss are respectively in contact with the space cam surfaces of the left guide rail and that of the right guide rail. The piston bodies at the left and right ends of the truss are respectively arranged in the countersunk through holes of the left cylinder block and that of the right cylinder block.

The plug of the left cylinder block, the countersunk-through hole of the left cylinder block, and the piston body located at the left end of the piston form a left closed cavity. The plug of the right cylinder block, the countersunk through hole of the right cylinder block, and the piston body located at the right end of the piston form a right closed cavity. The volume of the left closed cavity and that of the right closed cavity changes with the reciprocating motion of the piston. When the piston moves axially from the leftmost end to the rightmost end, the volume of the left closed cavity gradually increases while the volume of the right closed cavity gradually decreases. On the contrary, when the piston moves axially from the rightmost end to the leftmost end, the volume of the right closed cavity gradually increases while the volume of the left closed cavity gradually decreases.

The number of countersunk through holes, oil passages, and rectangular grooves on the left cylinder block are respectively twice the sum of the number of crests and valleys in the constant acceleration and constant deceleration guide rail curve. The number of through-hole flow passages on the flow distribution shaft is equal to the sum of the number of crests and valleys in the constant acceleration and constant deceleration guide rail curve. The number of large windows in each group of rectangular distribution windows is equal to the number of crests in the constant acceleration and constant deceleration guide rail curve, and the number of small windows is equal to the number of valleys in the constant acceleration and constant deceleration guide rail curve.

The oil enters the low-pressure flow passage of the pump core assembly from the low-pressure oil inlet. The piston assembly performs axial reciprocating linear motion under the constraint of the cylinder assembly and the guide rail assembly, and the volumes of the left closed cavity and the right closed cavity change continuously. wherein the oil passage (411E) corresponding to the closed cavity with increased volume communicates with the circular low-pressure flow channel (411A) connected with the low-pressure oil inlet (21), and inhales the oil by negative pressure, while the oil passage (411E) corresponding to the closed cavity with decreased volume communicates with the circular high-pressure flow channel from which the oil enters the third annular groove (24) of the pump casing (2), and then is discharged from the high-pressure oil outlet (22) of the pump casing (2).

Further, the constant acceleration and constant deceleration guide rail curve is provided with two crests and two valleys. The number of countersunk through holes, oil passages and rectangular grooves on the left cylinder block is eight respectively, and the number of circular low-pressure flow passages is six. The number of through-hole flow passages on the flow distribution shaft is four, and each group of rectangular distribution windows includes two large windows and two small windows.

Further, a plurality of needle rollers or balls are arranged between the pin shaft and the roller.

The advantages of the present invention are: (1) Adopting rolling support instead of sliding support. The transmission mechanism of the pump in the present invention adopts rolling support to replace the oil film support of the traditional axial piston pump. Compared with the traditional axial piston pump, it eliminates the formation of oil film during the starting process of the traditional axial piston pump, can realize fast forward and reverse rotation, and can start under load.

(2) Realizing the balance of axial inertia force of the whole pump. When the traditional axial piston pump rotates at high speed, the centrifugal force and inertial force of the rotating component cannot be ignored, because the centrifugal force and inertial force of the piston-slipper component increase with the quadratic of the rotation speed at this time, resulting in the tilting of the cylinder block. In the present invention, the whole pump is designed symmetrically in structure. Among the eight piston assemblies, two piston assemblies whose circumferential directions differ by 180° are a pair. The two pairs of piston assemblies with a circumferential difference of 90° always maintain reverse reciprocating motion under the constraint of the guide rail, so as to achieve the balance of the axial inertial force.

(3) Eliminating the gap between the pump guide rail and the roller. In the present invention, under the action of high-pressure oil and centrifugal force, the wedge blocks press the plane ends and the inclined plane grooves of the left and right guide rails. It stretches the left and right guide rails in the axial direction to make them close to the rollers, thereby eliminating the gap between the guide rails and the rollers.

(4) Theoretically, the structural flow pulsation of the whole pump is eliminated. Traditional axial piston pumps can cause structural flow pulsations due to their limited number of pistons. In the present invention, among the 8 piston assemblies, two piston assemblies with a circumferential difference of 180° are a pair, and the movements of the two pairs of piston assemblies with a circumferential difference of 45° make their corresponding flow phases different by 45°. And because the flow period corresponding to a single piston assembly is 90°, the structural flow pulsation is eliminated and the overall pulsation is reduced.

DESCRIPTION OF DRAWINGS

FIG. 10(*b*) is a cross-sectional view of the through hole of the distribution shaft.

FIG. 11(*b*) is a sectional view of the rail assembly.

FIG. 12(*b*) is a cross-sectional view when rotated by 0°. FIG. 12(*c*) is a sectional view rotated by 22.5°. FIG. 12(*d*) is a sectional view rotated by 45 degrees. FIG. 12(*e*) is a sectional view rotated by 67.5°. FIG. 12(*f*) is a sectional view rotated by 90°.

Figure 1:
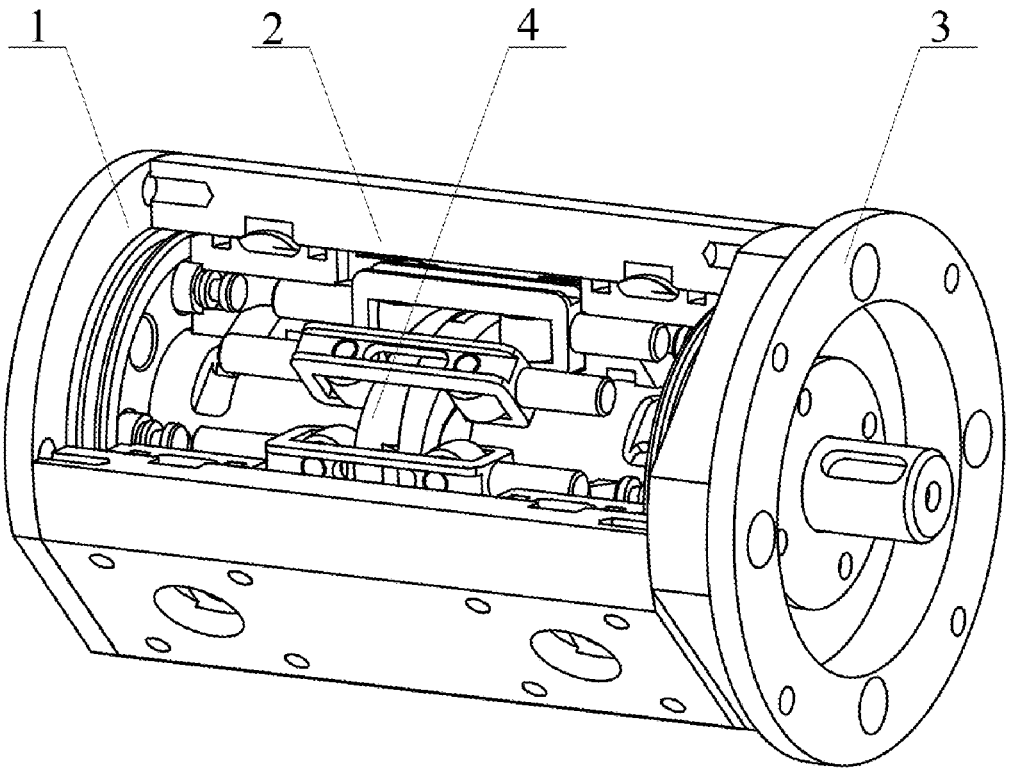
FIG. 1 is the structural representation of the invention.
Figure 2:
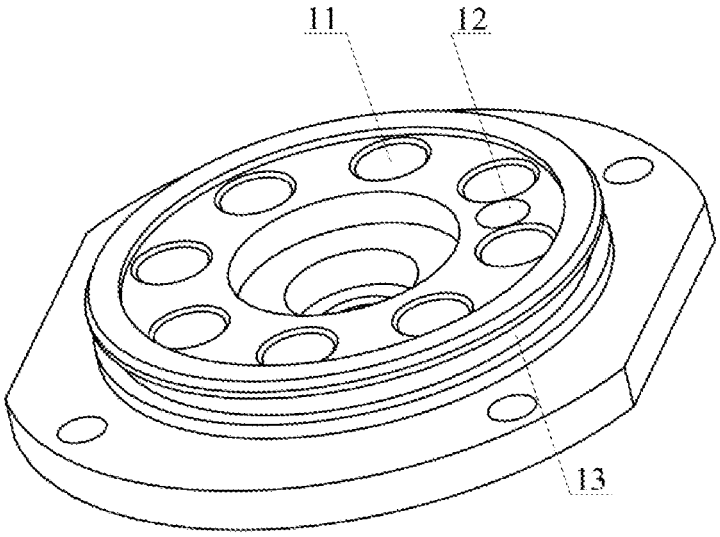
FIG. 2 is a schematic diagram of the structure of the front end cover.
Figure 3:
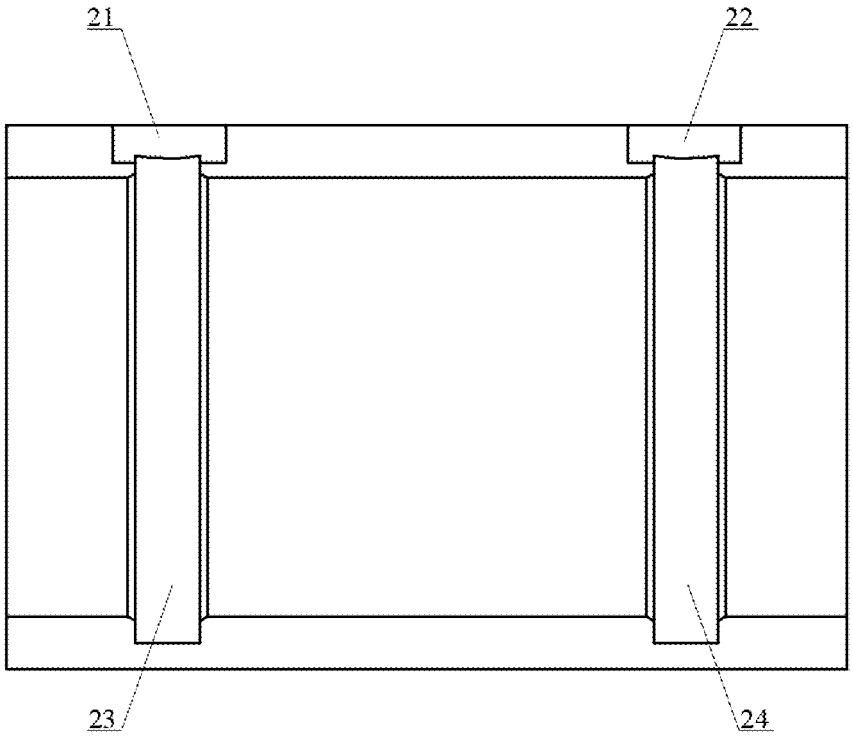
FIG. 3 is a schematic diagram of the structure of the pump casing.
Figure 4A:
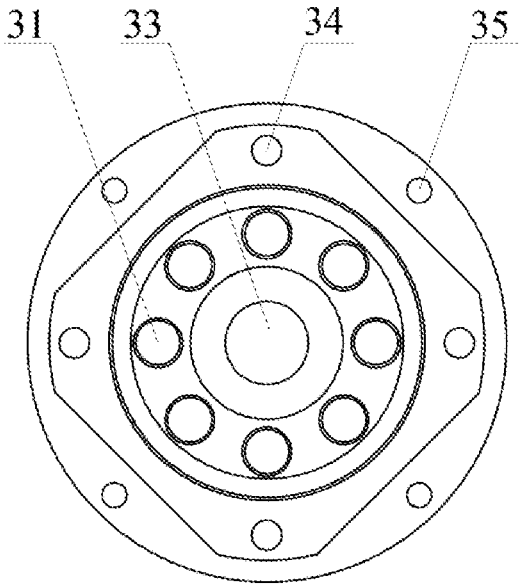
FIG. 4*a* is a schematic diagram of the structure of the rear end cover.
Figure 4B:
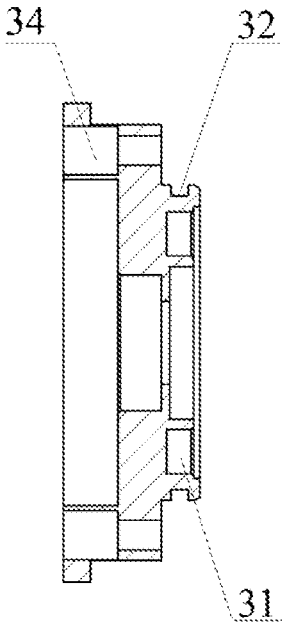
FIG. 4*b* is a cross-sectional view of the rear end cover.
Figure 5:
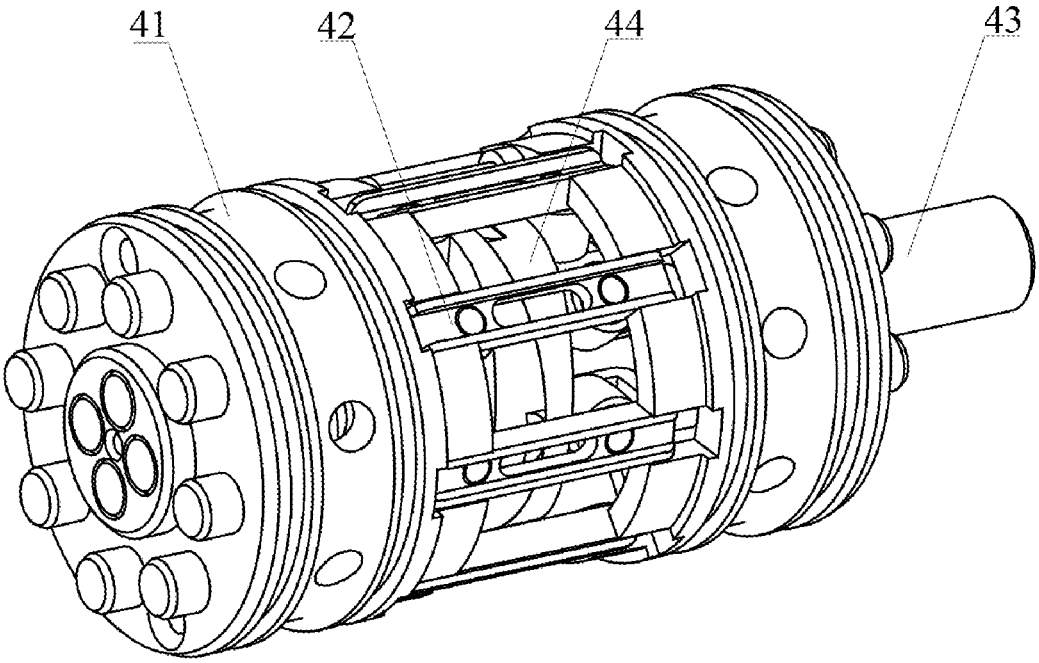
FIG. 5 is a schematic diagram of the structure of the pump core assembly.
Figure 6A:
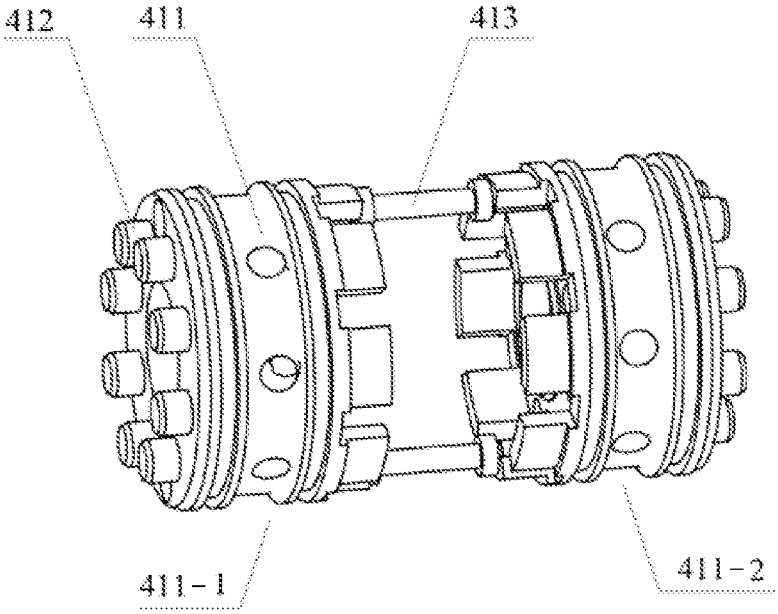
FIG. 6*a* is a schematic diagram of the structure of the cylinder assembly.
Figure 6B:
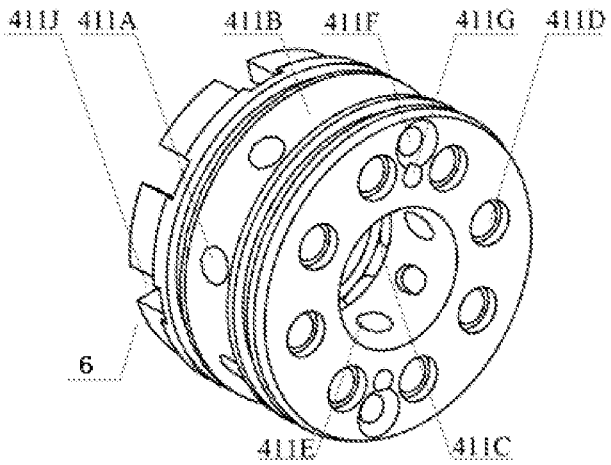
FIG. 6*b* is a schematic diagram of the structure of the left cylinder block.
Figure 6C:
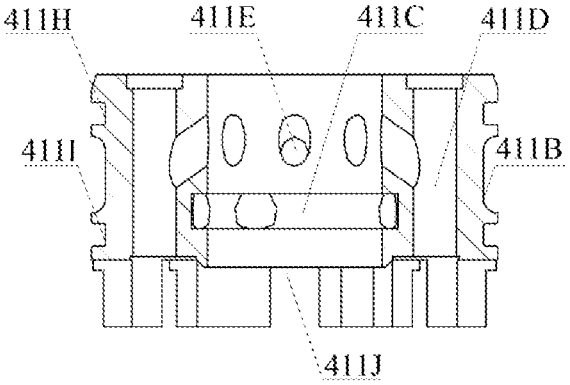
FIG. 6*c* is a cross-sectional view of a countersunk through hole.
Figure 6D:
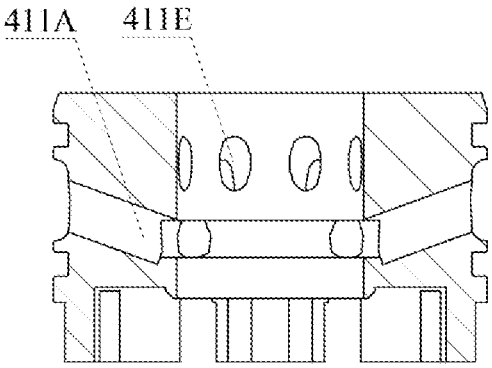
FIG. 6*d* is a cross-sectional view of the low-pressure flow channel.
Figure 7:
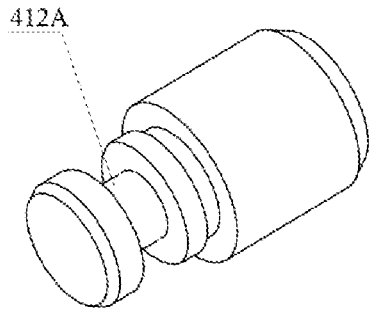
FIG. 7 is a schematic diagram of the structure of the plug.
Figure 8:
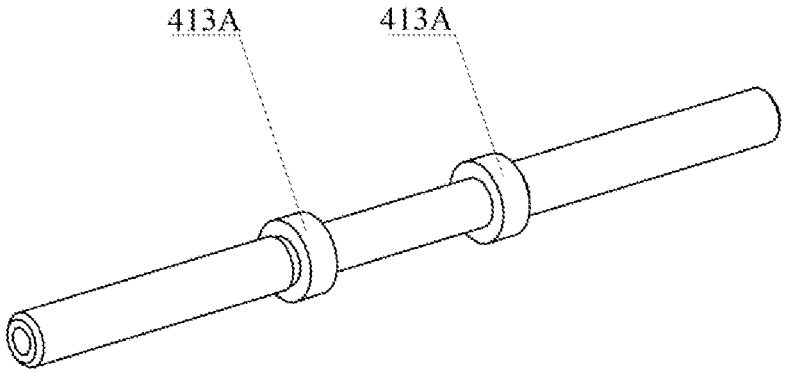
FIG. 8 is a schematic diagram of the structure of the positioning pin.
Figure 9:
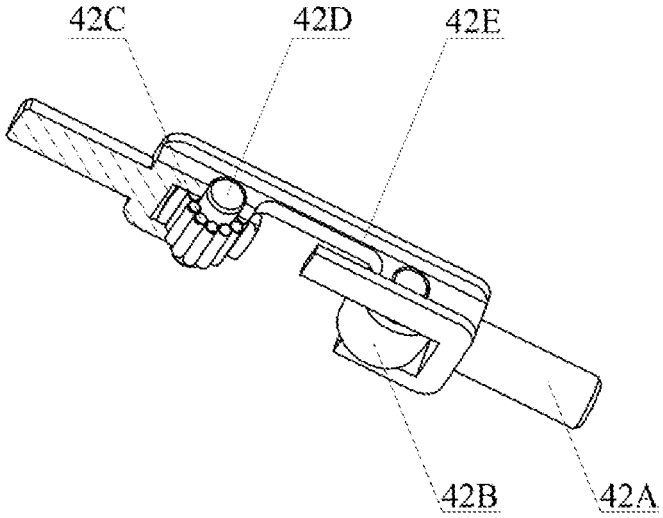
FIG. 9 is a schematic diagram of the structure of the piston assembly.
Figure 10A:
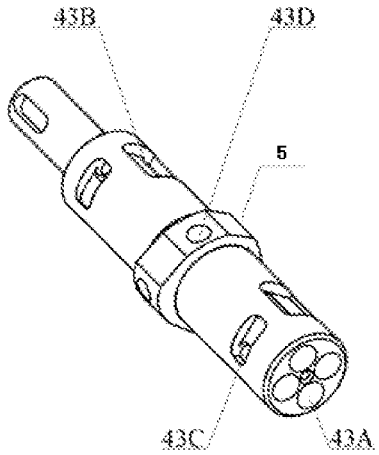
FIG. 10(*a*) is a schematic diagram of the structure of the distribution shaft.
Figure 10B:
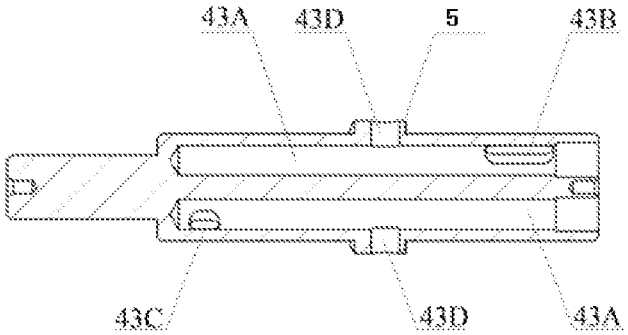
Figure 11A:
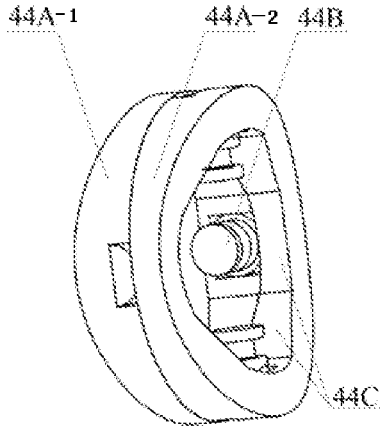
FIG. 11(*a*) is a schematic diagram of the structure of the guide rail assembly.
Figure 11B:
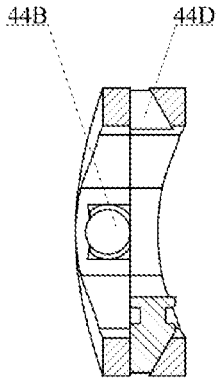
Figure 12A:
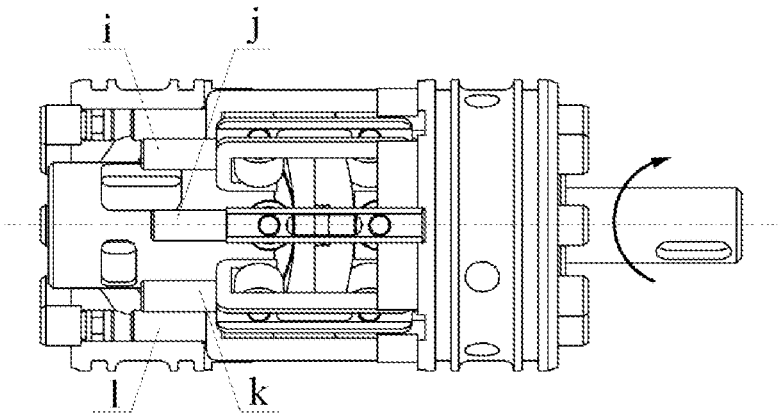
FIG. 12(*a*)~(*f*) is a schematic diagram of the working principle of shaft-distributed double-acting roller piston pump.
Figure 12B:
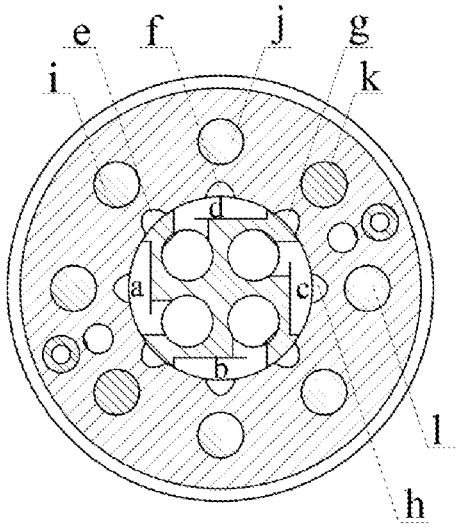
Figure 12C:
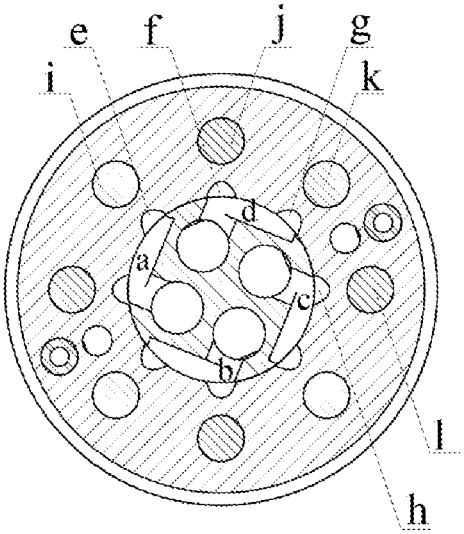
Figure 12D:
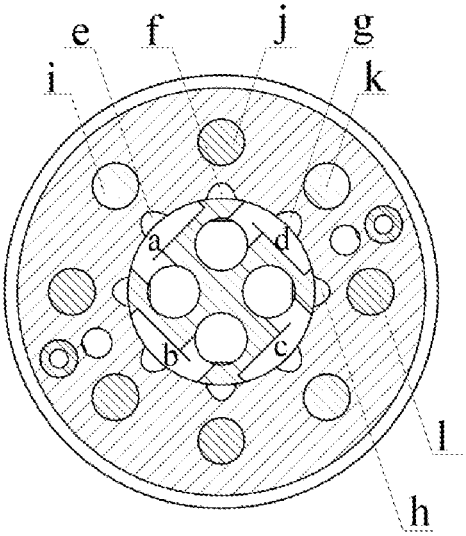
Figure 12E:
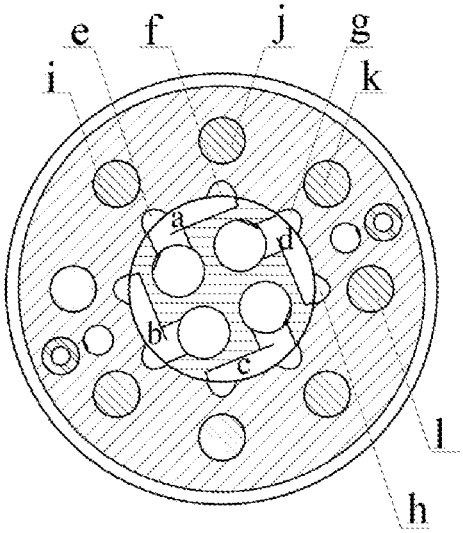
Figure 12F:
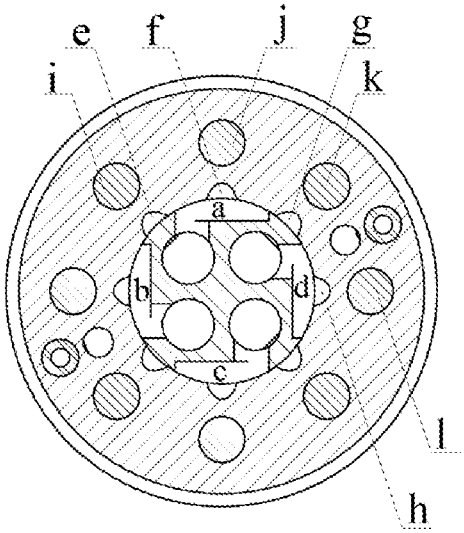

Description of reference numerals: 1. Front end cover, 11. First circular blind hole, 12. Oil leakage hole, 13. First annular groove, 2. Pump casing, 21. Low-pressure oil inlet, 22. High-pressure oil outlet, 23. The second annular groove; 24. The third annular groove; 3. The rear end cover, 31. The second circular blind hole, 32. The fourth annular groove, 33. The first through hole, 34. The countersunk hole; 35. Second through hole; 4.

Pump core assembly, 41. Cylinder block assembly, 411. Cylinder block, 411A. Circular low pressure flow channel, 411B. Fifth annular groove, 411C. Sixth annular groove, 411D. Countersunk head through hole, 411E. Oil passage, 411F. Pin hole, 411G. Oil leakage port, 411H. Seventh annular groove, 411I. Eighth annular groove, 411J. Rectangular groove, 412. Plug, 412A. Ninth annular groove, 413. Locating pin, 413A. Flange, 42. Piston assembly, 42A. Piston, 42B. Cylindrical roller, 42C. Needle roller, 42D. Pin shaft, 42E. Truss, 43. Flow distribution shaft, 43A. Through hole Flow channel, 43B. Large window, 43C. Small window, 43D. Radial circular hole; 44. Guide rail assembly, 44A. Guide rail, 44B. Wedge, 44C. Square key, 44D. Beveled groove, 5. boss, 6. annular boss, a. The first distribution window, b. The second distribution window, c. The third distribution window, d. The fourth distribution window, e. The first oil port, f. The second oil port, g. The third oil port; h, the fourth oil passage, i. The first piston assembly, j. The second piston assembly, k. The third piston assembly, l. The fourth piston assembly.

DETAILED DESCRIPTION OF THE EMBODIMENTS

The technical solutions of the patent of the present invention will be clearly and completely described below with reference to the accompanying drawings. Obviously, the described embodiments are some, but not all, embodiments of the present invention. Based on the embodiments of the present invention, all other embodiments obtained by those of ordinary skill in the art without creative efforts shall fall within the protection scope of the present invention.

In the description of the present invention, it should be noted that when the terms "center", "upper", "lower", "left", "right", "vertical", "horizontal", "inner", "outer". etc. indicate the orientation or positional relationship based on the orientation or positional relationship shown in the drawings. It is only for the convenience of describing the present invention and simplifying the description, not to indicate or imply that the indicated device or element must have a particular orientation, be constructed and operate in a particular orientation, and therefore should not be construed as a limitation of the present invention. Furthermore, the terms "first," "second," and "third," as they appear, are for descriptive purposes only and should not be construed to indicate or imply relative importance.

In the description of the present invention, it should be noted that, unless otherwise expressly specified and limited, the terms "installed", "connected" and "connected" should be interpreted in a broad sense. For example, it may be a fixed connection, a detachable connection, or an integral connection. It can be a mechanical connection or an electrical connection. It can be directly connected, or indirectly connected through an intermediate medium, and it can be the internal communication between two components. For those of ordinary skill in the art, the specific meanings of the above terms in the present invention can be understood in specific situations.

Referring to the drawings, a shaft-distributed double-acting roller piston pump comprises a front end cover 1, a pump casing 2 and a rear end cover 3 that are arranged in sequence and coaxially along the axis line. The cavity formed between the front end cover 1, the pump casing 2 and the rear end cover 3 is provided with a pump core assembly 4.

The pump casing 2 is cylindrical which is provided with a low pressure oil inlet 21 and a high pressure oil outlet 22 sequentially from left to right. The inner wall of the pump casing 2 is provided with a second annular groove 23 at a position corresponding to the low-pressure oil inlet 21 connected with the second annular groove 23. The inner wall of the pump casing 2 is provided with a third annular groove 24 at a position corresponding to the high-pressure oil outlet 22 connected with the third annular groove 24.

The pump core assembly 4 includes a cylinder assembly 41, a piston assembly 42, a flow distribution shaft 43 and a guide rail assembly 44. The axis line of the guide rail assembly 44 is coincident with that of the pump casing 2, and the guide rail assembly 44 includes a left guide rail 44A-1 and a right guide rail 44A-2 that are arranged back to back. The projections of the left rail 44A-1 and the right rail 44A-2 in the axial direction are annular. The side surface of the left guide rail 44A-1 and the right guide rail 44A-2 close to each other is a plane surface, and the side surface of the left guide rail 44A-1 and the right guide rail 44A-2 away from each other is a space cam curved surface. The curved surface of the space cam is constructed by a constant acceleration and constant deceleration curve with two crests and two troughs. The crest of the left rail 44A-1 corresponds to the trough of the right rail 44A-2, that is, the high points on the left rail 44A-1 corresponds to the low points on the right rail 44A-2.

A square key 44C is provided in the center hole of the left guide rail 44A-1 and that of the right guide rail 44A-2, and beveled grooves 44D are respectively formed on the surface of the left guide rail 44A-1 and that of the right guide rail 44A-2 close to each other, and the beveled groove 44D is provided with a wedge 44B of which both sides are respectively installed in the beveled groove 44D and in the radial circular hole 43D of the flow distribution shaft 43.

The end of wedge 44B installed at the beveled groove 44D has a flat surface fit with the plane of one guide rail and an inclined surface matched with the beveled groove 44D of another guide rail. The end of the wedge 44B installed in the radial circular hole 43D has a column matched with the radial circular hole 43D, and an annular groove for installing the sealing ring is provided on the column.

The flow distribution shaft 43 is cylindrical, and the flow distribution shaft 43 is installed in the center holes of the left guide rail 44A-1 and the right guide rail 44A-2. The right end of the flow distribution shaft 43 passes through the first through hole 33 in the center of the rear end cover to the right and is connected to the driving device. The middle part of the flow distribution shaft 43 is provided with a boss 5 fitting with the square key 44C of the guide rail 44A, and the boss is provided with a radial circular hole 43D matched with the wedge 44B. Four through-hole flow channels 43A are uniformly distributed on the distribution shaft 43 along the circumferential direction, and the axis of the through-hole flow channels 43A is parallel to the axis of the flow distribution shaft 43. The areas beside the boss 5 on the flow distribution shaft (43) is respectively provided with a group of rectangular flow distribution windows. Each group of rectangular flow distribution windows includes two large windows 43B and two small windows 43C, the large windows 43B and the small windows 43C are staggered along the circumferential direction, and the large windows 43B and the small windows 43C communicate with the corresponding through-hole flow channels 43A respectively.

The cylinder assembly 41 includes a left cylinder block 411-1 and a right cylinder block 411-2 coaxially arranged with the pump casing 2. The middle of the left cylinder block 411-1 is uniformly distributed with six radially through circular low pressure flow channels 411A along the circumferential direction while the corresponding structure in the right cylinder 411-2 is circular high pressure flow channels. The fifth annular groove 411B and the sixth annular groove 411C are respectively opened on the outer and inner walls of the left cylinder block 411 at positions corresponding to the circular low pressure flow channels 411A, and the fifth annular groove 411B and the sixth annular groove 411C respectively communicates the oil inlet and the oil outlet of the circular low-pressure flow channel 411A. The left end face of the left cylinder block 411 has eight countersunk through holes 411D evenly distributed along the circumferential direction. The countersunk through hole 411D and the circular low-pressure flow channel 411A are dislocated. The inner wall of the left portion of the left cylinder block 411-1 is provided with eight oil passages 411E along the circumferential direction, and the oil passages 411E communicate with the countersunk through holes 411D. The left end face of the left cylinder block 411 is also provided with two pin holes 411F with a phase difference of 180°, two oil leakage ports 411G with a phase difference of 180°, and the oil leakage ports 411G communicate with the oil leakage holes 12 provided on the front end cover. The right end of the left cylinder block 411-1 is provided with an annular boss 6 protruding axially along the left cylinder block 411-1, and the annular boss 6 is provided with 8 rectangular grooves 411J uniformly distributed in the circumferential direction. The outer peripheral wall of the left cylinder block 411 is also provided with a seventh annular groove 411H and an eighth annular groove 411I for installing the sealing ring. The left cylinder block 411-1 and the right cylinder block 411-2 have the same structure, and are disposed on the left and right sides of the guide rail assembly 44 in opposite directions.

The left cylinder block 411-1 and the right cylinder block 411-2 are connected by positioning pins 413. The positioning pin 413 is cylindrical, and the positioning pin 413 is divided into a first section, a second section and a third section in turn from left to right. Two flanges 413A are provided on the second section, and the two flanges 413A are respectively matched with the pin holes 411F on the left cylinder block 411-1 and the right cylinder block 411-2. A plug 412 is provided at the end of the countersunk through hole 411D away from the guide rail assembly 44 on the left cylinder block 411-1 and the right cylinder block 411-2. The plug 412 is cylindrical, and the plug 412 is provided with a ninth annular groove 412A for installing the sealing ring.

A piston assembly 42 is provided in the countersunk through hole 411D between the left cylinder block 411-1 and the right cylinder block 411-2. The piston assembly 42 includes a piston 42A, a cylindrical roller 42B, a needle roller 42C and a pin 42D. The piston 42A includes a truss 42E and a piston body connected to the left and right ends of the truss 42E. The truss 42E is provided with pin holes symmetrically left and right. The axis of the pin hole is arranged along the radial direction of the pump casing 2, and a pin shaft 42D is installed in the pin hole, and a roller 42B is installed on the pin shaft 42D, and a plurality of needle rollers 42C or balls are arranged between the pin shaft 42D and the roller 42B. The left and right rollers 42B on the truss 42E are respectively in contact with the space cam curved surfaces of the left guide rail 44A-1 and the right guide rail 44A-2. The piston bodies at the left and right ends of the truss 42E are respectively disposed in the countersunk through holes 411D of the left cylinder block 411-1 and the right cylinder block 411-2.

The plug 412 of the left cylinder block 411-1, the countersunk through hole 411D of the left cylinder block 411-1, and the piston body located at the left end of the piston 42A form a left closed cavity. The plug 412 of the right cylinder block 411-2, the countersunk through hole 411D of the right cylinder block 411-2, and the piston body located at the right end of the piston 42A form a right closed cavity. The volumes of the left closed cavity and the right closed cavity vary with the reciprocating motion of the piston 42A. When the piston 42A moves axially from the leftmost end to the rightmost end, the volume of the left closed cavity gradually increases, and the volume of the right closed cavity gradually decreases. On the contrary, when the piston 42A moves axially from the rightmost end to the leftmost end, the volume of the right closed cavity gradually increases, and the volume of the left closed cavity gradually decreases.

The oil enters the low-pressure flow channel 411A of the pump core assembly 4 from the low-pressure oil inlet 21. The guide rail assembly 44 rotates with the flow distribution shaft 43. The piston assembly 42 performs axial reciprocating linear motion under the constraint of the cylinder assembly 41 and the guide rail assembly 44, and the volumes of the left closed cavity and the right closed cavity change continuously. The oil passage (411E) corresponding to the closed cavity with increased volume communicates with the circular low-pressure flow channel 411A onnected with the low-pressure oil inlet 21, and inhales the oil by negative pressure. The oil passage 411E of the closed cavity with reduced volume communicates with the circular high-pressure flow channel uniformly distributed on the middle of the right cylinder block 411-2, the oil enters the third annular groove 24 of the pump casing 2 from the circular high pressure flow channel, and the oil is discharged from the high-pressure oil outlet 22 of the pump casing 2.

A first circular blind hole 11 is opened at a position corresponding to the plug 412 of the left cylinder block 411-1 on the right end surface of the front end cover 1. An oil leakage hole 12 is opened on the right end surface of the front end cover 1 at a position corresponding to the oil leakage port 411G connected with the oil leakage hole 12. The outer peripheral wall of the front end cover 1 is provided with a first annular groove 13 for installing the sealing ring.

A second circular blind hole 31 is opened on the left end surface of the rear end cover 3 at a position corresponding to the plug 412 of the right cylinder block 411-2. The outer peripheral wall of the rear end cover 3 is provided with a fourth annular groove 32 for installing the sealing ring. The center of the rear end cover 3 is provided with a first through hole 33, and the right end surface of the rear end cover 3 is provided with four countersunk holes 34 evenly distributed in the circumferential direction. The countersunk hole 34 is connected to the pump casing 2 by bolts, and four second through holes 35 evenly distributed in the circumferential direction are opened on the right end surface of the rear end cover 3, and the second through holes 35 are used for connecting tooling.

It should be noted that, the roller of the present invention can also use other bearings to achieve rolling support in addition to using needle roller bearings to achieve rolling support. In addition, the rollers can also be supported by static pressure. The backlash compensation between the guide rail and the roller can be realized by using disc spring or spring in addition to hydrostatic support. In addition to the use of guide rails, the transmission mechanism can also be implemented with a swash plate, as long as the number of crests and valleys is twice the number of pistons. In addition, the piston material can also use chromium copper or other composite materials, and the piston surface can also be directly surface treated with chrome plating, DLC, etc. in addition to surface hardening heat treatment.

The working principle of this embodiment:

During operation, the flow distribution shaft 43 rotates under the traction of the high-speed motor, and rotates clockwise when viewed from the right side to the left. The guide rail assembly is driven to rotate synchronously by the square key 44C on the guide rail assembly 44.

One end surface of the guide rail 44A is provided with a space cam curved surface constructed by constant acceleration and constant deceleration curves. The constant acceleration and constant deceleration guide curve has 2 peaks and 2 valleys. Under the constraint of the cylinder assembly 41 and the guide rail assembly 44, the piston assembly 42 performs axial reciprocating linear motion, and the cylindrical roller 42B always rolls on the curved surface of the guide rail 44A. The left and right sides of the piston 42A and the cylinder block 411 both form a closed cavity, and the piston assembly 42 performs an axial reciprocating motion.

The oil enters into the low-pressure flow channel 411A of the pump core assembly 4 from the low-pressure oil inlet 21. Due to the axial reciprocating motion of the piston assembly 42, the volume of the left and right closed cavities changes continuously. The closed cavity with the increased volume communicates with the circular low-pressure flow channel 411A through the oil passage 411E, and the circular low-pressure flow channel 411A communicates with the low-pressure oil inlet 21, and oil is inhaled by the negative pressure.

The oil passage 411E of the closed cavity with reduced volume communicates with the circular high-pressure flow channel to discharge the oil. The oil enters the third annular groove 24 of the pump casing 2 from the circular high-pressure flow channel, and then discharges the oil from the high-pressure oil outlet 22 of the pump casing 2. During one rotation of the motor, a piston assembly sucks and discharges oil 4 times. Among the 8 piston assemblies, two piston assemblies with a circumferential difference of 180° are a pair, and the motion laws of the two piston assemblies are completely consistent.

Figure 13:
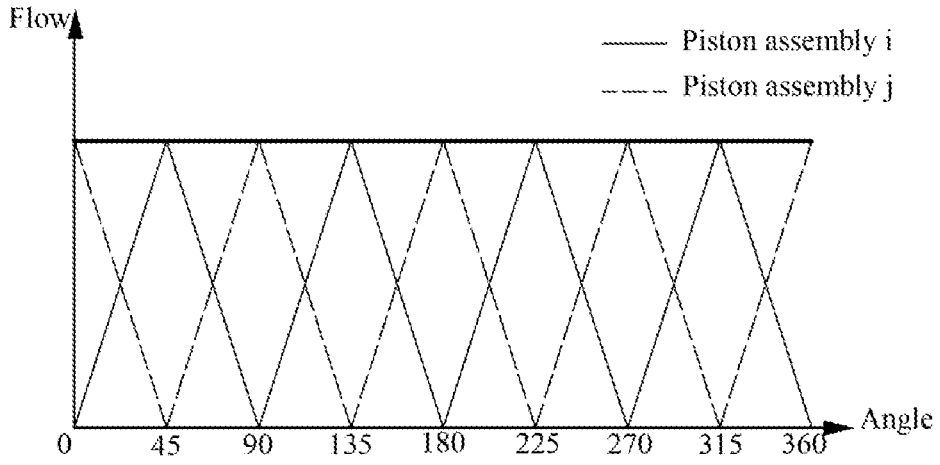
FIG. 13 is a graph showing the flow rate change of the piston assembly i and the piston assembly j.

The flow distribution principle is shown in FIGS. 12-13 (*c*). Taking 4 adjacent piston assemblies i, j, k and l for illustration; taking the left closed cavity for illustration.

Initially, the circumferential rotation angle of the flow distribution shaft over the left cylinder block is 0 degrees. At this time, the piston assembly l is at the leftmost end of the stroke, and the volume of the closed cavity it corresponds is the smallest. The piston assembly j is at the far right end of the stroke, and the volume of the closed cavity it corresponds is the largest. At this time, the oil passage e corresponding to the piston assembly i and the oil passage g corresponding to the piston assembly k do not communicate with the distribution window on the flow distribution shaft at all. The oil passage f corresponding to the piston assembly j and the oil passage c corresponding to the piston assembly l are in complete communication with the distribution window on the flow distribution shaft.

During the rotation of the flow distribution shaft over the left cylinder block from 0 degrees to 22.5 degrees, the flow distribution shaft and the guide rail assembly rotate clockwise. The piston assembly i moves axially to the right, the piston assembly j moves axially to the left, the piston assembly k moves axially to the left, and the piston assembly l moves axially to the right. Furthermore, the volume of the left closed cavity corresponding to the piston assembly i gradually increases, and the corresponding oil passage e and the distribution window a gradually communicate until they are completely communicated, and the oil is sucked into the left closed cavity. The volume of the left closed cavity corresponding to the piston assembly j gradually decreases, and the corresponding oil passage f and the distribution window d are always in a state of complete communication. The oil is pressed out of the left closed cavity through the distribution window d, enters the through-hole flow channel of the flow distribution shaft, and is discharged from the large distribution window on the right side. The volume of the left closed cavity corresponding to the piston assembly k is gradually reduced, and the corresponding oil passage g and the distribution window d are gradually communicated until they are completely communicated. The oil is pressed out of the left closed cavity through the distribution window d, enters the through-hole flow channel of the flow distribution shaft, and is discharged from the large distribution window on the right side. The volume of the left closed cavity corresponding to the piston assembly l gradually increases, and the corresponding oil passage h and the distribution window c are always in a state of complete communication, and the oil is sucked into the left closed cavity.

During the rotation of the flow distribution shaft over the left cylinder block from 22.5 degrees to 45 degrees, the piston assembly i continues to move axially to the right, the piston assembly j continues to move axially to the left, and the piston assembly k continues to move axially to the left, and the piston assembly l continues to move axially to the right. Furthermore, the volume of the left closed cavity corresponding to the piston assembly i continues to increase, and the corresponding oil passage e and the distribution window a continue to be in complete communication, and the oil is sucked into the left closed cavity. The volume of the left closed cavity corresponding to the piston assembly j gradually decreases, and the communication area between the corresponding oil passage f and the distribution window d gradually decreases from a state of complete communication to a state of no communication at all. The oil is pressed out of the left closed cavity through the distribution window d, enters the through-hole flow channel of the flow distribution shaft, and is discharged from the large distribution window on the right side. The volume of the left closed cavity corresponding to the piston assembly k gradually decreases, and the corresponding oil passage g and the distribution window d remain in a state of complete communication. The oil is pressed out of the left closed cavity through the distribution window d, enters the through-hole flow channel of the distribution shaft, and is discharged from the large distribution window on the right side. The volume of the left closed cavity corresponding to the piston assembly l gradually increases, and the corresponding oil passage h and the distribution window c decrease from a state of complete communication to a state of complete non-communication, and the oil is sucked into the left closed cavity. At this time, the piston assembly i is at the rightmost end of the stroke, and its corresponding closed cavity has the largest volume; the piston assembly k is at the leftmost end of the stroke, and its corresponding closed cavity has the smallest volume.

During the rotation of the flow distribution shaft over the left cylinder block from 45 degrees to 67.5 degrees, the piston assembly i moves axially to the left, the piston assembly j moves axially to the left, the piston assembly k moves axially to the right, and the piston assembly l moves axially to the right. Furthermore, the volume of the left closed cavity corresponding to the piston assembly i decreases, and the corresponding oil passage e and the distribution window a maintain a state of complete communication. The oil is pressed out of the left closed cavity through the distribution window a, enters the through-hole flow channel of the flow distribution shaft, and is discharged from the large distribution window on the right side. The volume of the left closed cavity corresponding to the piston assembly j gradually decreases, and the corresponding oil passage passage f and the distribution window a gradually begin to communicate until they are completely communicated. The oil is pressed out of the left closed cavity through the distribution window a, enters the through-hole flow channel of the flow distribution shaft, and is discharged from the large distribution window on the right side. The volume of the left closed cavity corresponding to the piston assembly k gradually increases, and the corresponding oil passage g and the distribution window d remain in a state of complete communication, and the oil is sucked into the left closed cavity. The volume of the left closed cavity corresponding to the piston assembly l gradually increases, and the corresponding oil passage h and the distribution window d gradually begin to communicate until they are completely communicated, and the oil is sucked into the left closed cavity.

In the process of rotating of the flow distribution shaft over the left cylinder block from 67.5 degrees to 90 degrees, the piston assembly i continues to move axially to the left, the piston assembly j continues to move axially to the left, the piston assembly k continues to move axially to the right, and the piston assembly l continues to move axially to the right. Furthermore, the volume of the left closed cavity corresponding to the piston assembly i continues to decrease, and the corresponding oil passage e and the distribution window a gradually decrease from a state of complete communication to a state of no communication at all. The oil is pressed out of the left closed cavity through the distribution window a, enters the through-hole flow channel of the flow distribution shaft, and is discharged from the large distribution window on the right side. The volume of the left closed cavity corresponding to the piston assembly j continues to decrease, and the corresponding oil passage f and the distribution window a maintain a state of complete communication. The oil is pressed out of the left closed cavity through the distribution window a, enters the through-hole flow channel of the flow distribution shaft, and is discharged from the large distribution window on the right side. The volume of the left closed cavity corresponding to the piston assembly k gradually increases, and the corresponding oil passage g and the distribution window d decrease from a state of complete communication to a state of complete non-communication, and the oil is sucked into the left closed cavity. The volume of the left closed cavity corresponding to the piston assembly l gradually increases, and the corresponding oil passage h and the distribution window d continue to be in complete communication, and the oil is sucked into the left closed cavity. At this time, the piston assembly l is at the rightmost end of the stroke, and its corresponding closed cavity has the largest volume. The piston assembly j is at the leftmost end of the stroke, and its corresponding closed cavity has the smallest volume.

When the rotation angle of the flow distribution shaft over the left cylinder block reaches 90 degrees, a piston assembly completes a cycle of oil suction and discharge process, and the corresponding working state of the right closed cavity is opposite to that of the left closed cavity. The left and right closed cavities of a piston assembly alternately suck and discharge oil. In a 90-degree cycle, one piston assembly completes one oil suction and discharge, and the whole pump has 8 piston assemblies, so it completes 8 oil suction and discharge. In the process of one rotation of the motor, the whole pump completes 32 times of oil suction and discharge.

Among the 8 piston assemblies, two piston assemblies with a circumferential difference of 180° are a pair, and the motion patterns of the two piston assemblies are completely consistent.

During the rotation of the motor, the piston assembly i and the piston assembly k always maintain the opposite axial reciprocating motion, and the piston assembly j and the piston assembly l always maintain the opposite axial reciprocating motion. In addition, among the eight piston assemblies, two piston assemblies with a circumferential difference of 180° are a pair, and the motion patterns of the two piston assemblies are completely consistent. Therefore, the two pairs of piston assemblies with a circumferential difference of 90° always keep the reverse reciprocating motion under the constraint of the guide rail, thereby realizing the balance of the axial inertial force.

Among the 8 piston assemblies, two piston assemblies with a circumferential difference of 180° are a pair, and the motion laws of the two piston assemblies are completely consistent. As shown in FIG. 13), the piston assembly j is taken as an example, its circumferential direction differs by 45°, so the phase difference of its flow change curve is 45°. And because the flow change cycle of a single piston assembly is 90 degrees, the flow change curves of the two piston assemblies are superimposed to form a straight line. The whole pump includes 8 piston assemblies, and two piston assemblies with a circumferential difference of 180° are a pair. The movement of the two pairs of piston assemblies with a circumferential difference of 45° makes their corresponding flow phases different by 45°. And because the flow period corresponding to a single piston assembly is 90°, the structural flow pulsation is eliminated and the overall pulsation is reduced.

The content described in the embodiments of the present specification is merely an enumeration of the implementation forms of the inventive concept. The scope of the present invention should not be construed as limited to the specific form set forth in the embodiments. The protection scope of the present invention also extends to equivalent technical means that can be conceived by those skilled in the art according to the inventive concept.

The invention claimed is:

1. A shaft-distributed double-acting roller piston pump comprises a front end cover, a pump casing and a rear end cover arranged in sequence and coaxially along a first axis line, and a cavity formed between the front end cover and the pump casing, and the rear end cover is provided with a pump core assembly;

the pump casing is cylindrical and is provided with a low pressure oil inlet and a high pressure oil outlet sequentially from left to right; an inner wall of the pump casing is provided with a second annular groove at a position corresponding to the low-pressure oil inlet which communicates with the second annular groove; the inner wall of the pump casing is provided with a third annular groove at a position corresponding to the high-pressure oil outlet which communicates with the third annular groove;

the pump core assembly includes a cylinder block assembly, a piston assembly, a flow distribution shaft and a guide rail assembly, wherein an axis line of the guide rail assembly coincides with the first axis line of the pump casing; and the guide rail assembly includes a left guide rail and right guide rail that are arranged back to back, wherein the projection of the left guide rail and the right guide rail in the direction of the first axis is circular, and a side surface of the left guide rail and the right guide rail facing each other is a plane while a side surface facing away from each other is a space cam curved surface constructed by a constant acceleration and constant deceleration curve with multiple crests and troughs wherein the number of the crests is equal to that of the troughs, wherein the crests of the left guide rail corresponds to the troughs of the right guide rail with the high points on the left guide rail corresponding to the low points on the right guide rail;

a square key is provided in a center hole of the left guide rail and that of the right guiderail, and beveled grooves are respectively formed on surfaces of the left guide rail and that of the right guide rail close to each other, and the beveled groove is provided with a wedge of which both sides are respectively installed in the beveled groove and in a radial circular hole of a flow distribution shaft;

the flow distribution shaft is cylindrical and passes through the center holes of the left guide rail and that of the right guide rail, and a right end of which passes through a first through hole in the center of the rear end cover; a middle part of the flow distribution shaft is provided with a boss fitting with the square key of the guide rail assembly, and the boss is provided with a radial circular hole matched with the wedge; several through-hole flow channels are uniformly distributed on the flow distribution shaft along a circumferential direction, and an axis of the through-hole flow channels is parallel to that of the flow distribution shaft; the areas beside the boss on the flow distribution shaft are respectively provided with a group of rectangular flow distribution windows including large windows and small windows which are staggered along a circumferential direction of the flow distribution shaft, and are connected with the corresponding through-hole flow channels respectively;

a cylinder block assembly includes a left cylinder block and a right cylinder block coaxially arranged within the pump casing which have the same structure, and are respectively disposed on a left side and right side of the guide rail assembly in opposite directions;

a middle of the left cylinder block is uniformly provided with several radially through circular low pressure flow channels along a circumferential direction; a fifth annular groove and a sixth annular groove respectively connected with the low pressure oil inlet and the high pressure oil outlet of the circular low-pressure flow channels and are respectively opened on outer and inner walls of the left cylinder block at positions corresponding to the circular low pressure flow channels; a left end face of the left cylinder block has several countersunk through holes evenly distributed along a circumferential direction and dislocated with the circular low-pressure flow channels; the inner wall of the left portion of the left cylinder block is provided with several oil passages along a circumferential direction which are connected with the countersunk through holes; the left end face of the left cylinder block is also provided with two pin holes with a phase difference of 180°, two oil leakage ports with a phase difference of 180°; the right end face of the left cylinder block is provided with an annular boss protruding axially along the left cylinder block which is provided with several rectangular grooves uniformly distributed in a circumferential direction; an outer peripheral wall of the left cylinder block is also provided with a seventh annular groove and an eighth annular groove for installing a sealing ring;

the left cylinder block and the right cylinder block are connected by positioning pins which are cylindrical, and are divided into a first section, a second section and a third section sequentially from left to right, and two flanges are provided on the second section which are respectively matched with the pin holes on the left cylinder block and that on the right cylinder block; and a plug is respectively provided at a end of the countersunk through hole away from the guide rail assembly on the left cylinder block and that on the right cylinder block; and the plug is cylindrical and is provided with a ninth annular groove for installing the sealing ring;

a first circular blind hole is opened on a right end surface of the front end cover at a position corresponding to the plug of the left cylinder block; an oil leakage hole connected with the oil leakage port of the left cylinder block is opened on the right end surface of the front end cover at a position corresponding to the oil leakage port; an outer peripheral wall of the front end cover is provided with a first annular groove for installing the sealing ring;

a second circular blind hole is opened on a left end surface of the rear end cover at a position corresponding to the plug of the right cylinder block and a outer peripheral wall of the rear end cover is provided with a fourth annular groove for installing the sealing ring;

a center of the rear end cover is provided with a first through hole, and the right end surface of the rear end cover is provided with several countersunk holes evenly distributed in a circumferential direction which are connected to the pump casing by bolts, and several second through holes evenly distributed in a circumferential direction are opened on the right end surface of the rear end cover which are used for connecting tooling;

a piston assembly provided in the countersunk through hole between the left cylinder block and the right cylinder block comprises a piston, a cylindrical roller, a needle roller and a pin, wherein the piston comprises a truss and a piston body connected to left and right ends of the truss, and the truss is provided with pin holes symmetrically left and right of which an axis is arranged along the radial direction of the pump casing, and a pin shaft installed in the pin hole is provided a roller; the left and right rollers on the truss are respectively in contact with the space cam curved surfaces of the left guide rail and that of the right guide rail; the piston bodies at the left and right ends of the truss are respectively disposed in the countersunk through holes of the left cylinder block and that of the right cylinder block;

the plug of the left cylinder block, the countersunk through hole of the left cylinder block, and the piston body located at the left end of the piston form a left closed cavity, and the plug of the right cylinder block, the countersunk through hole of the right cylinder block, and the piston body located at the right end of the piston form a right closed cavity; the volume of the left closed cavity and that of the right closed cavity vary with the reciprocating motion of the piston, wherein as the piston moves axially from the leftmost end to the rightmost end, the volume of the left closed cavity gradually increases while the volume of the right closed cavity gradually decreases; on the contrary, when the piston moves axially from the rightmost end to the leftmost end, the volume of the right closed cavity gradually increases while the volume of the left closed cavity gradually decreases;

the number of countersunk through holes, oil passages, and rectangular grooves on the left cylinder block are respectively twice the sum of the number of crests and valleys in the constant acceleration and constant deceleration guide rail curve; and the number of through-hole flow passages on the flow distribution shaft is equal to the sum of the number of crests and valleys in the constant acceleration and constant deceleration guide rail curve; the number of large windows in each group of rectangular distribution windows is equal to the number of crests in the constant acceleration and constant deceleration guide rail curve, and the number of small windows is equal to the number of valleys in the constant acceleration and constant deceleration guide rail curve;

oil enters the low pressure flow channel of the pump core assembly from the low pressure oil inlet, and the guide rail assembly rotates with the distribution shaft, and the piston assembly performs axial reciprocating linear motion under the constraint of the cylinder block assembly and the guide rail assembly, and the volumes of the left closed cavity and the right closed cavity change continuously, wherein the oil passage corresponding to the closed cavity with increased volume communicates with the circular low-pressure flow channel connected with the low-pressure oil inlet, and inhales the oil by negative pressure, while the oil passage corresponding to the closed cavity with decreased volume communicates with the circular high-pressure flow channel from which the oil enters the third annular groove of the pump casing), and then is discharged from the high-pressure oil outlet of the pump casing.

2. The shaft-distributed double-acting roller piston pump according to claim 1, wherein the constant acceleration and constant deceleration guide rail curve is provided with two crests and two troughs, and the number of countersunk through holes on the left cylinder block (411-1), oil passages, and rectangular grooves is eight respectively, and the number of circular low-pressure flow channels is six; the number of channels on the flow distribution shaft is four, and each group of rectangular distribution windows includes two large windows and two small windows.

3. The shaft-distributed double-acting roller piston pump according to claim 1, wherein a plurality of needle rollers or balls are arranged between the pin shaft and the roller.

* * * * *